US007204695B1

(12) United States Patent
Shiu et al.

(10) Patent No.: US 7,204,695 B1
(45) Date of Patent: Apr. 17, 2007

(54) FASTENER STRUCTURE

(75) Inventors: Kuang-Hua Shiu, Jhongli (TW); Chien-Chung Lin, Hukou Township, Hsinchu County (TW)

(73) Assignee: Singatron Enterprise Co., Ltd., Hsinchu County (TW)

( * ) Notice: Subject to any disclaimer, the term of this patent is extended or adjusted under 35 U.S.C. 154(b) by 0 days.

(21) Appl. No.: 11/378,371

(22) Filed: Mar. 20, 2006

(51) Int. Cl.
*H01R 11/30* (2006.01)

(52) U.S. Cl. ..... 439/38; 439/950; 439/305

(58) Field of Classification Search ..... 439/950, 439/38, 305
See application file for complete search history.

(56) References Cited

U.S. PATENT DOCUMENTS 3,350,675 A * 10/1967 Misencik et al. ..... 439/39
3,496,500 A * 2/1970 Romary ..... 335/205
5,178,548 A * 1/1993 Fortmann et al. ..... 439/52
5,833,496 A * 11/1998 Hollander et al. ..... 439/620.05
6,727,477 B1 * 4/2004 Li-Chen ..... 219/494

* cited by examiner

*Primary Examiner*—Truc Nguyen
(74) *Attorney, Agent, or Firm*—Troxell Law Office, PLLC

(57) ABSTRACT

A fastener structure includes a connector plug and a connector socket. A protruding connecting portion is formed on one side of the connector plug, and a plurality of aligned terminals and fool-proof fasteners are configured on the protruding connecting portion. The electric conducting spring pieces are correspondingly connected to positive and negative poles of a power cable, and the positive and negative poles of the power cable and a transformer are correspondingly connected to butt spring pieces protruding from two sides of the protruding connecting portion. When the protruding connecting portion is plugged into the fixing slot, the butt spring pieces of the protruding connecting portion make contact with the electric conducing spring pieces, thereby enabling the passive electromagnetic member to produce a magnetic effect that achieves the objective of magnetic joining of the connector plug and the connector socket and electrical connection to a power supply.

3 Claims, 8 Drawing Sheets

FASTENER STRUCTURE

BACKGROUND OF THE INVENTION (a) Field of the Invention

The present invention provides an improved fastener structure that uses a protruding connecting portion of one side of a connector plug to correspondingly fit into a fixing slot of one side of a connector socket.

(b) Description of the Prior Art

Referring to FIGS. 1 and 2, which show a general magnetic connector, wherein one side of a plug B of a connector A is configured with a plurality of terminals B1 that correspond to a matching plurality of pins C1 of a socket C. When the plug B and the socket C are joined together, a magnetic body C2 of one side of the socket C and a contact body B2 of the side of the plug B enable the supply of power from a power supply equipment. However, the magnetic body C2 located on the side of the socket C easily attracts objects D, such as clips, metal fillings, and so on, prior to being joined to the contact body B2 located on the side of the plug. If a user does not notice the objects D on the magnetic body C2 and joins the plug B of the connector A to the socket C, a short circuit results between the plug B and the socket C, which further causes a short circuit in the power supply equipment and subsequent damage thereto.

Hence, the inventor of the present invention proposes to resolve and surmount existent technical difficulties to eliminate the aforementioned shortcomings of prior art.

SUMMARY OF THE INVENTION

The present invention provides an improved fastener structure that uses a protruding connecting portion of one side of a connector plug to correspondingly fit into a fixing slot of one side of a connector socket. When the protruding connecting portion is lined up for joining to the fixing slot, butt spring pieces protruding from two sides of the protruding connecting portion make contact with electric conducing spring pieces of a passive electromagnetic member, thereby enabling the passive electromagnetic member to produce a magnetic effect that achieves the objective of magnetic joining of the connector plug and the connector socket and electrical connection to a power supply.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
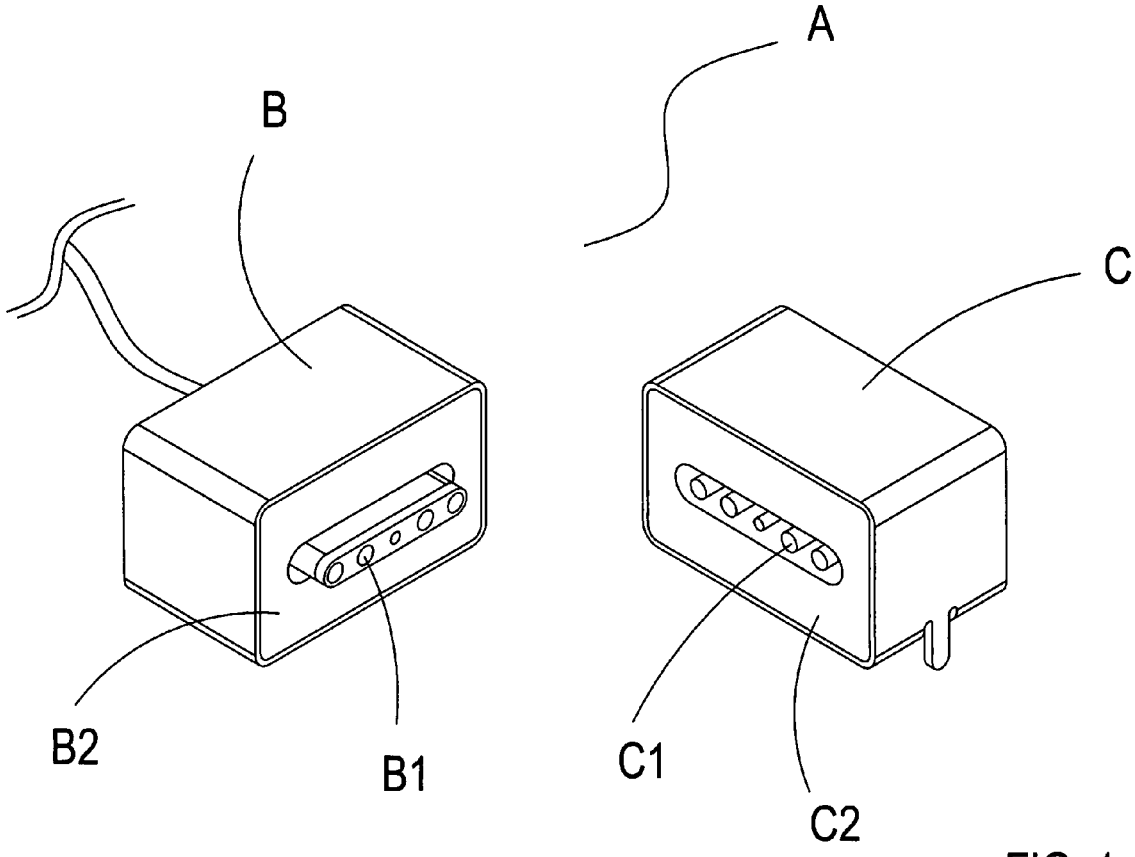
FIG. 1 Prior Art
FIG. 1 shows an elevational view of a magnetic connector of prior art.
Figure 2:
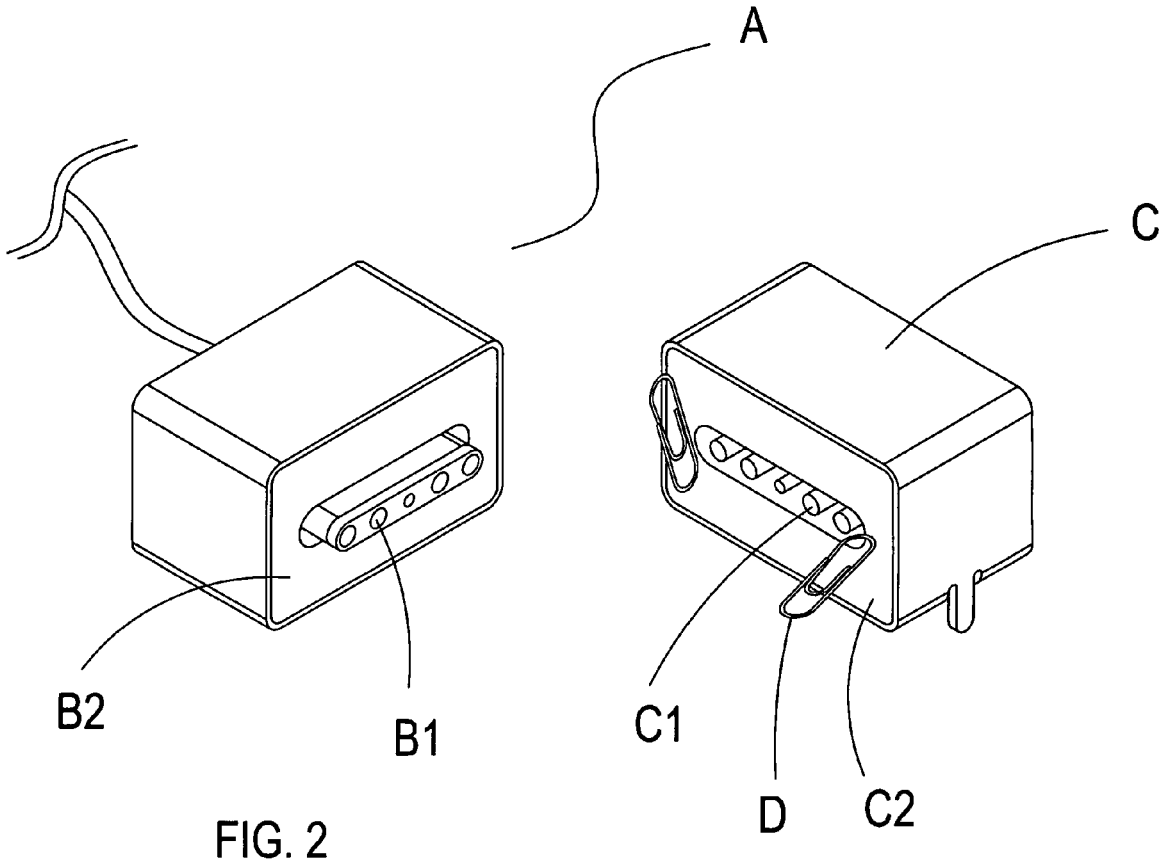
FIG. 2 Prior Art
FIG. 2 shows a schematic view of a magnetic connector of prior art.
Figure 3:
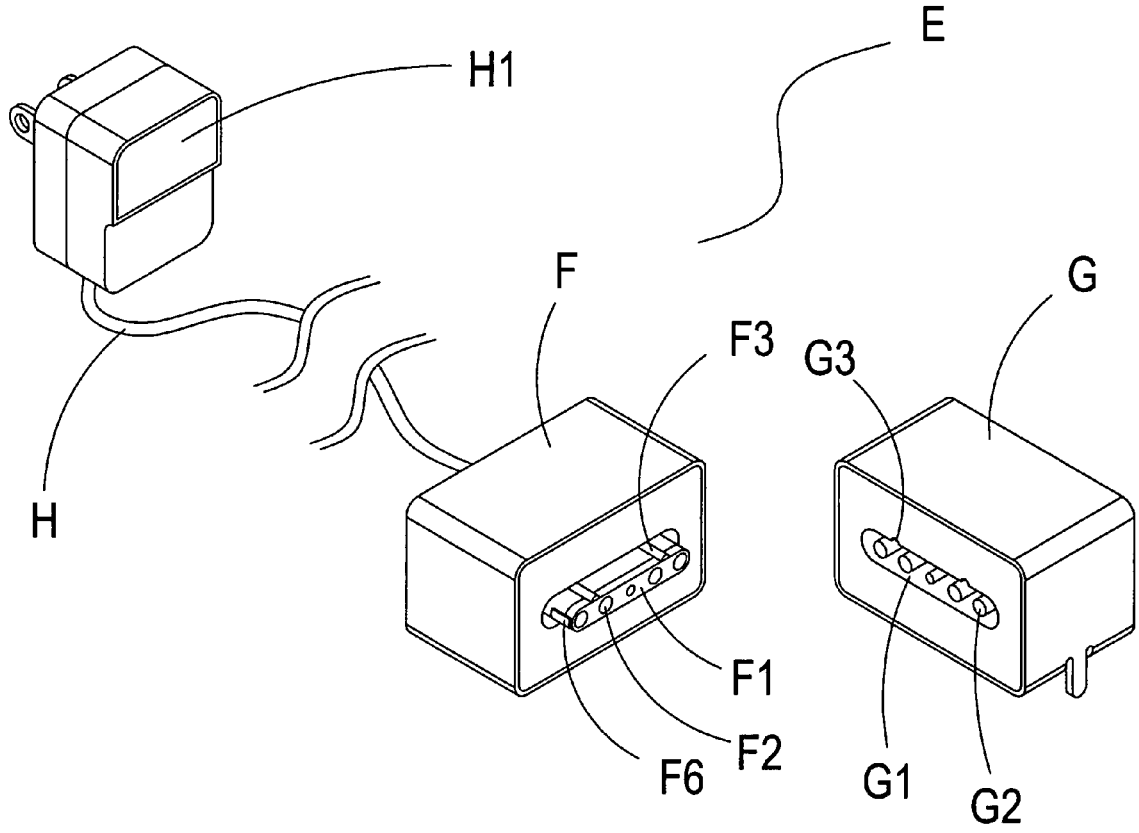
FIG. 3 shows an elevational view according to the present invention.
Figure 4:
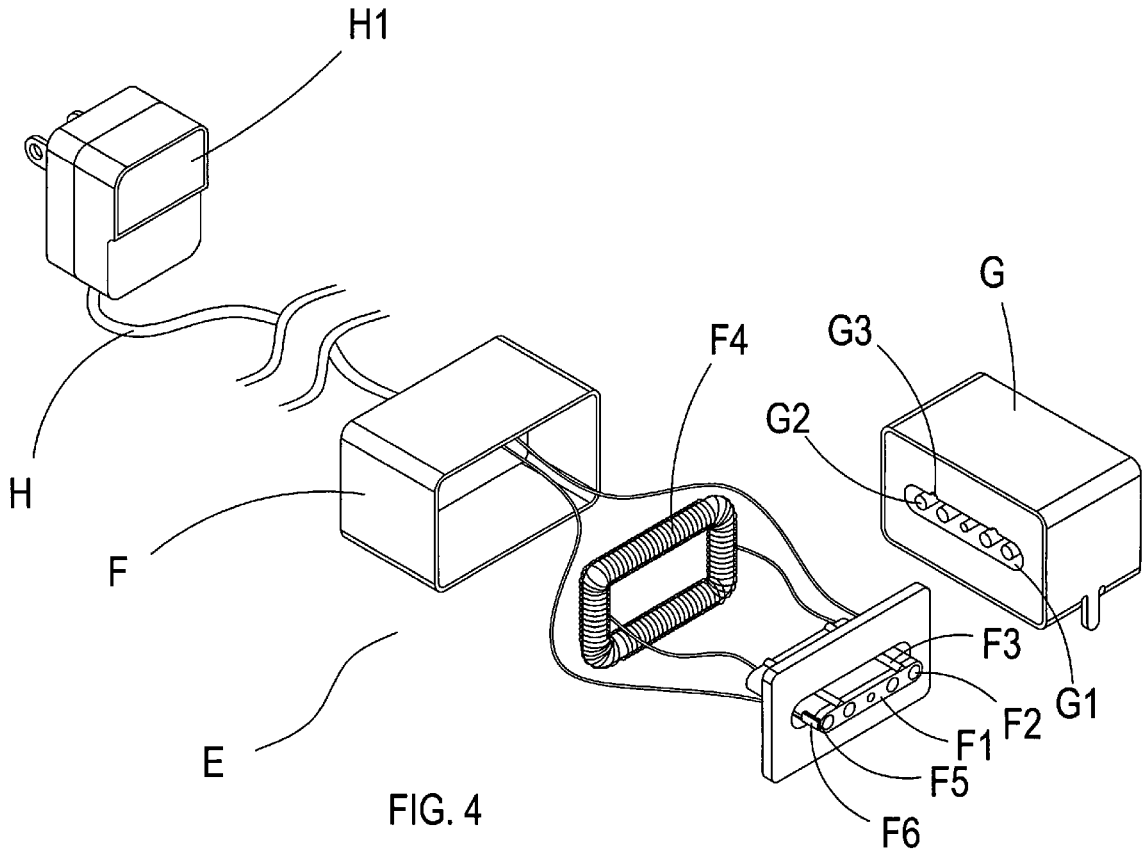
FIG. 4 shows an exploded view according to the present invention.

Referring to FIGS. 3 and 4, which show an improved structure for a fastener of the present invention, wherein a fastener structure E comprises a connector plug F and a connector socket G. A protruding connecting portion F1 is formed on one side of the connector plug F, and a plurality of terminals F2 and fool-proof fasteners F3 are configured on the protruding connecting portion F1. A passive electromagnetic member F4 and electric conducting spring pieces F5 are configured between the plurality of terminals F2 and the protruding connecting portion F1.

The electric conducting spring pieces F5 are correspondingly connected to positive and negative poles of a power cable H. Moreover, the positive and negative poles of the power cable H and a transformer H1 are correspondingly connected to butt spring pieces F6 protruding from two sides of the protruding connecting portion F1. Furthermore, the butt spring pieces F6 are correspondingly fitted into a fixing slot G1 defined in the connector socket G.

The fixing slot G1 is configured with a plurality of terminals G2, and guide grooves G3 are defined at one side of the terminals G2 corresponding to the fool-proof fasteners F3 of the connector plug F. The fool-proof fasteners F3 and the guide grooves G3 are used to guide the plurality of terminals F2 of the connector plug F into the plurality of terminals G2 of the connector socket G when plugging the connector plug F into the connector socket G, thereby enabling the fastener structure E to be accurately joined together. With such a configuration, when joining the connector plug F to the connector socket G, the fool-proof fasteners F3 and the guide grooves G3 guide the protruding connecting portion F1 of the connector plug F into the fixing slot G1 of the connector socket G. Moreover, when the butt spring pieces F6 of the protruding portion F1 make contact with the electric conducting spring pieces F5 of the passive electromagnetic member F4, the magnetic effect produced by the passive electromagnetic member F4 achieves the objective of magnetic joining of the connector plug F and the connector socket G and electrical connection to a power supply.

Figure 5:
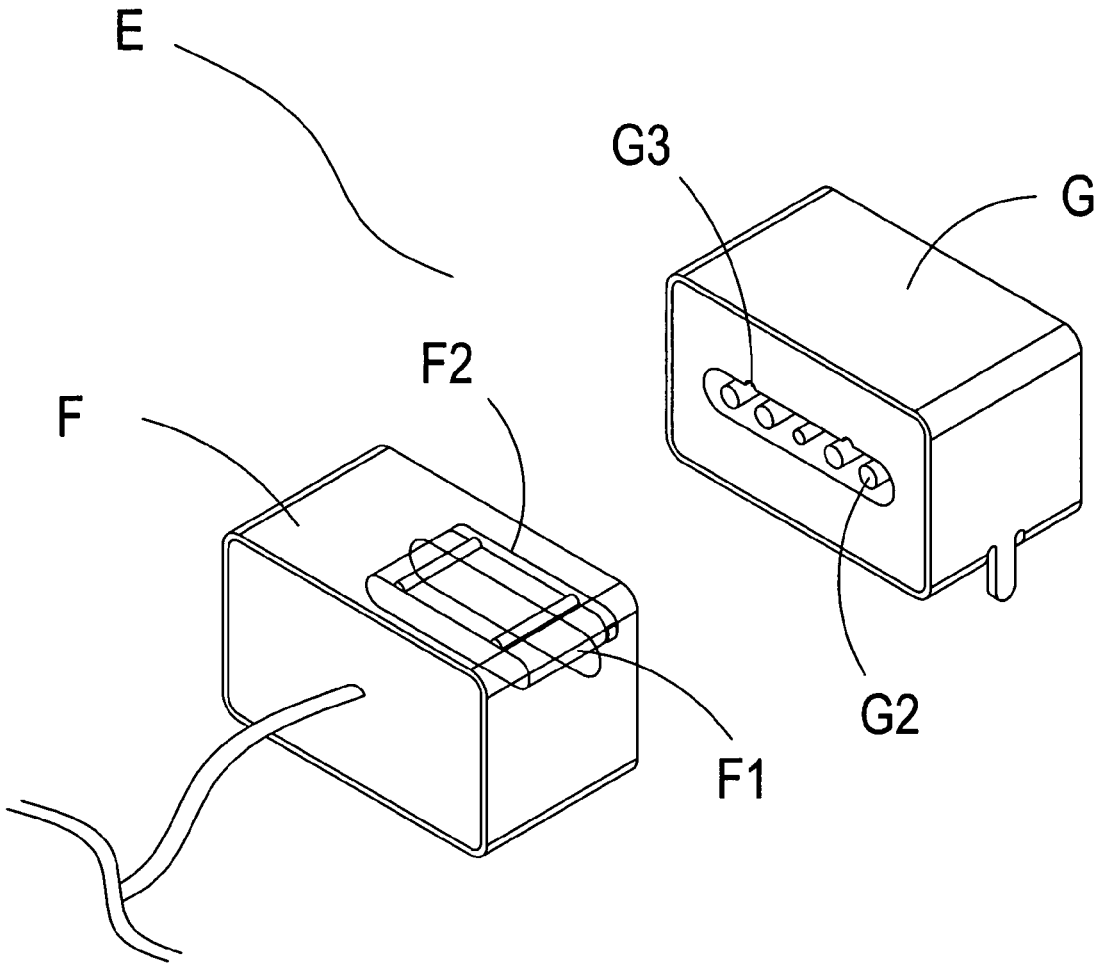
FIG. 5 shows a cutaway view according to the present invention.

Referring to FIG. 5, which shows an embodiment of the present invention, when the protruding connecting portion F1 located on one side of the connector plug F is plugged into the fixing slot G1 of the connector socket G, the fool-proof fasteners F3 located on one side of the protruding connecting portion F1 and the guide grooves G3 of one side of the fixing slot G1 enable accurate guiding of the plurality of terminals F2 of the connector plug F into the respective plurality of terminals G2 of the connector socket G, thereby effecting a connection between the connector plug F and the connector socket G and achieving accurate joining of the connector plug F and the connector socket G of the fastener structure E.

Figure 6:
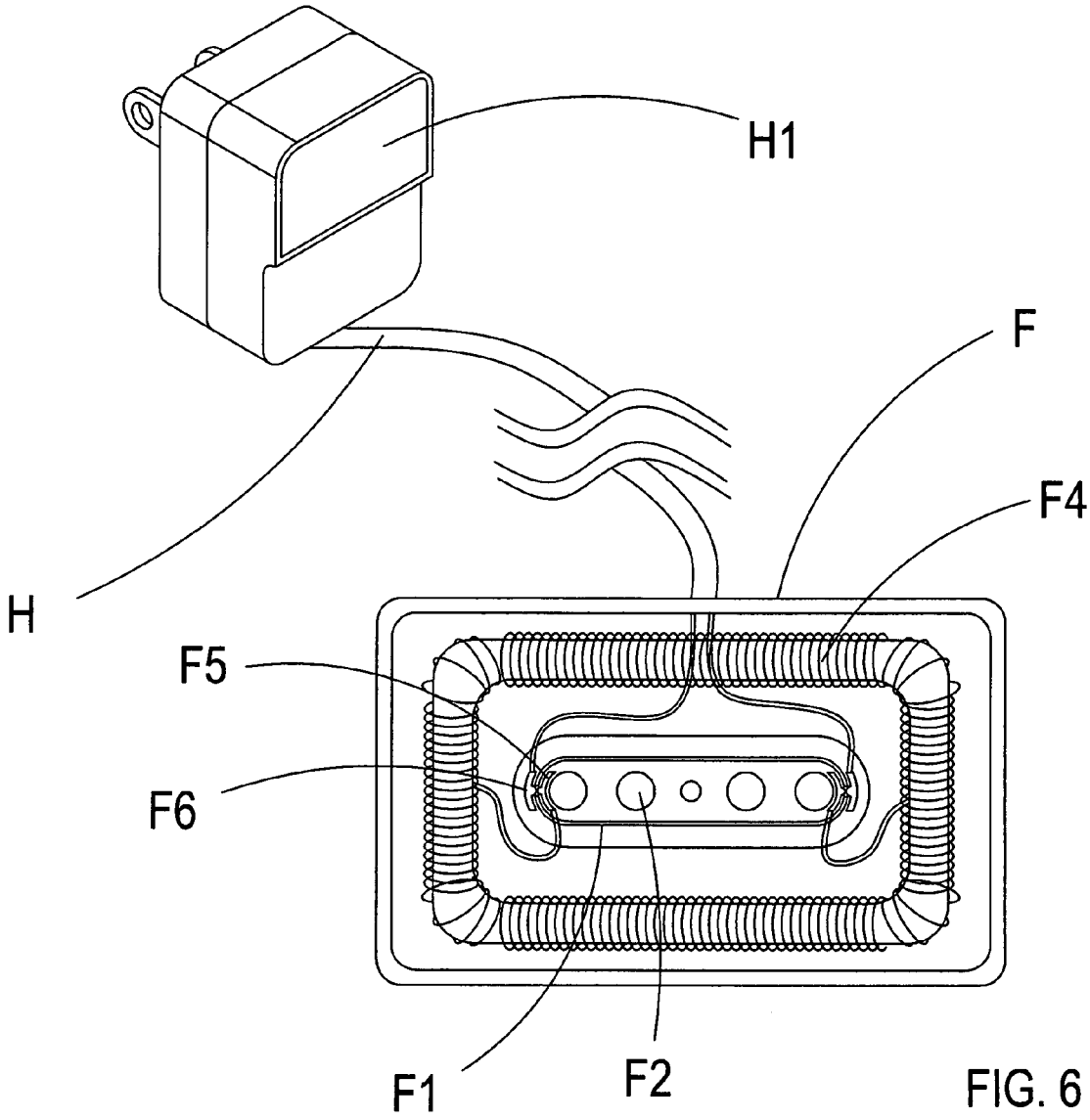
FIG. 6 shows a first view of an embodiment according to the present invention.

Referring to FIG. 6, which shows the passive electromagnetic member F4 and the electric conducting spring pieces F5 configured between the plurality of terminals F2 and the protruding connecting portion F1, wherein the electric conducting spring pieces F5 are correspondingly connected to the positive and negative poles of the power cable H. and the positive and negative poles of the power cable H and the transformer H1 are correspondingly connected to the butt spring pieces F6 located on two sides of the protruding connecting portion F1. When the protruding connecting portion F1 located on one side of the connector plug F is plugged into the fixing slot G1 of the connector socket G, the butt spring pieces F6 make contact with the electric conducting spring pieces F5, thereby enabling the passive electromagnetic member F4 to produce a magnetic effect that achieves the objective of magnetic joining of the connector plug F and the connector socket G of the fastener structure E.

Figure 7:
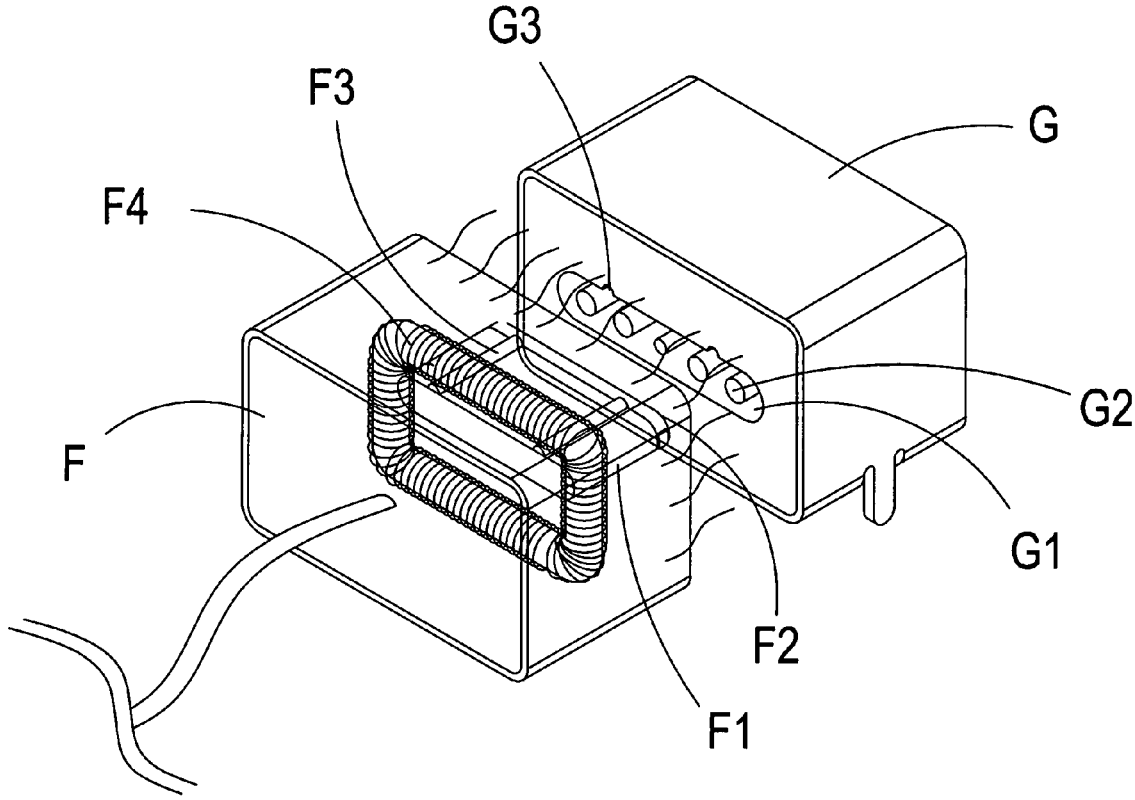
FIG. 7 shows a second view of the embodiment according to the present invention.

Referring to FIG. 7, which shows the fixing slot G1 of the connector socket G lined up with the protruding connecting portion F1 located on one side of the connector plug F. Moreover, the fool-proof fasteners F3 and the plurality of terminals F2 of the protruding connecting portion F1 are lined up with the guide grooves G3 and the plurality of terminals G2 of the fixing slot G1 respectively. When the protruding connecting portion F1 of the connector plug F is plugged into the fixing slot G1 of the connector socket G, the magnetic effect produced by the passive electromagnetic member F4 enables signal transmission and achieves effectiveness to magnetically join the connector plug F and the connector socket G of the fastener structure E.

Figure 8:
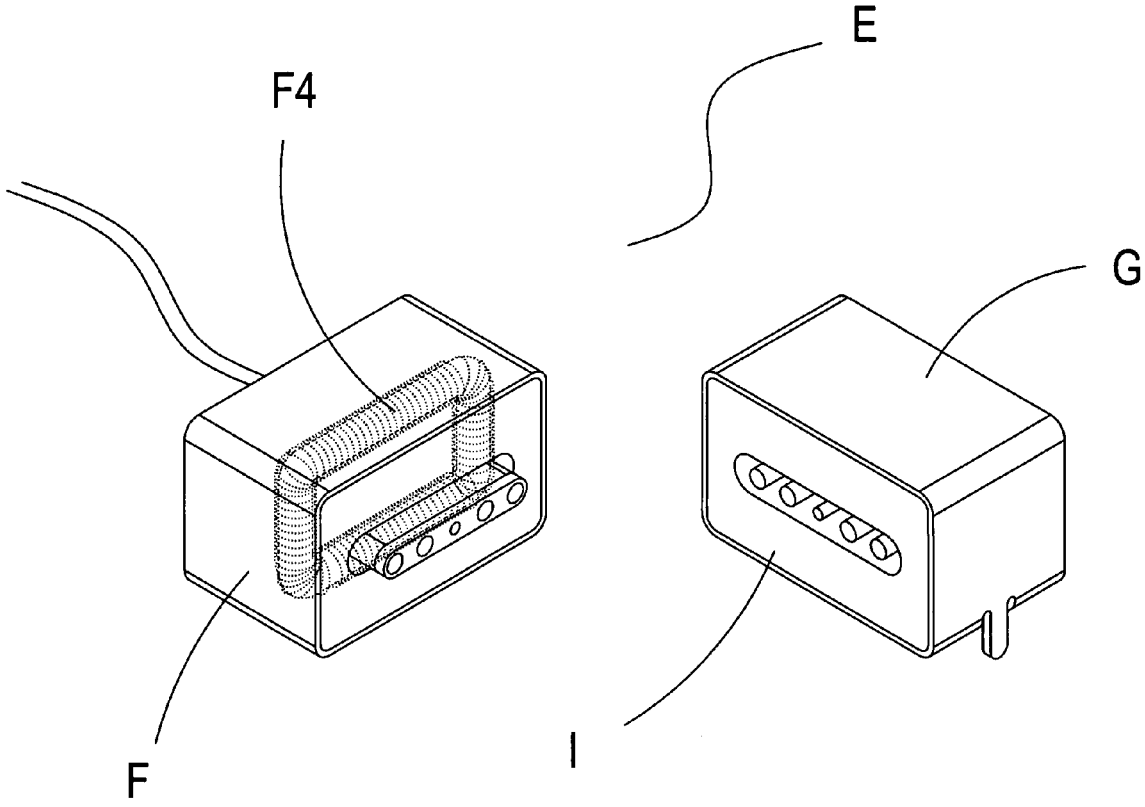
FIG. 8 shows a third view of the embodiment according to the present invention.

Referring to FIG. 8, which shows the passive electromagnetic member F4 further configured as a electromagnetic coil, a permanent magnet, a magnet or other related magnetic member having a magnetic attraction effect, wherein such a magnetic member is able to magnetically attract a metallic plate I of the connector socket G, when the connector plug F of the fastener structure E is lined up with the connector socket G, thereby achieving the objective of magnetic joining of the connector plug F and the connector socket G of the fastener structure E.

In order to better explicitly disclose advancement and practicability of the present invention, a comparison with prior art is described hereinafter:

SHORTCOMINGS OF PRIOR ART

1. A magnetic body of one side of the connector socket easily attracts clips, metal fillings and other related metal objects.
2. If a user does not notice the attracted objects on the magnetic body, it can easily result in a short circuit between the plug and the socket.
3. The resulting short circuit between the plug and the socket easily causes a short circuit in a power supply equipment and damage thereto.

ADVANTAGES OF THE PRESENT INVENTION

1. The fool-proof fasteners F3 and the guide grooves G3 enable the connector plug F to be accurately plugged into the connector socket G when joining together the fastener structure E.
2. The butt spring pieces F6 and the electric conducting spring pieces F5 enable the passive electromagnetic member F4 to produce a magnetic effect.
3. The passive electromagnetic member F4 does not produce a magnetic effect when the connector plug F and the connector socket G are separated.
4. Because of advantage 2, joining together of the connector plug F and the connector socket G through magnetic attraction achieves the objective of power connection and signal transmission.
5. Because of advantage 3, the present invention does not magnetically attract clips, or other related metallic objects that can cause a short circuit.
6. Provided with practicability and advancement.
7. Enhances commercial competitiveness.

In conclusion, the present invention in overcoming structural shortcomings of prior art has assuredly achieved effectiveness of anticipated advancement, and, moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A fastener structure comprising a connector plug and a connector socket; a protruding connecting portion is formed on one side of the connector plug, and a plurality of aligned terminals and fool-proof fasteners are configured on the protruding connecting portion; a passive electromagnetic member and electric conducting spring pieces are configured between the plurality of aligned terminals and the protruding connecting portion; the electric conducting spring pieces are correspondingly connected to positive and negative poles of a power cable, and the positive and negative poles of the power cable and a transformer are correspondingly connected to butt spring pieces protruding from two sides of the protruding connecting portion; the butt spring pieces are correspondingly fitted into a fixing slot of the connector socket, when the protruding connecting portion is plugged into the fixing slot, the butt spring pieces of the protruding connecting portion make contact with the electric conducing spring pieces, thereby enabling the passive electromagnetic member to produce a magnetic effect that achieves the objective of magnetic joining of the connector plug and the connector socket and electrical connection to a power supply.

2. The fastener structure according to claim 1, wherein the protruding connecting portion of the connector plug correspondingly fits into the fixing slot of the connector socket, the fool-proof fasteners and the plurality of aligned terminals of the protruding connecting portion correspondingly fit into the guide grooves and the plurality of aligned terminals of the fixing slot respectively; when the connector plug is lined up and joined to the connector socket, the magnetic effect produced by the passive electromagnetic member enables achieving the objective of electrical connection to a power supply and signal transmission.

3. The fastener structure according to claim 1, wherein the electromagnetic member is further configured as an electromagnetic coil, a permanent magnet, a magnet or related structures having a magnetic effect, which is paired with a magnetically attractive piece, thereby achieving effectiveness to magnetically join the connector plug and the connector socket when connecting the two together.

* * * * *